US005927141A

United States Patent [19]

Walsten

[11] Patent Number: 5,927,141

[45] Date of Patent: Jul. 27, 1999

[54] CONDUIT BENDER HEAD

[75] Inventor: Dean R. Walsten, Slinger, Wis.

[73] Assignee: Applied Power Inc., Butler, Wis.

[21] Appl. No.: 09/054,057

[22] Filed: Apr. 2, 1998

[51] Int. Cl.[6] ..... B21D 7/14; B21J 13/08

[52] U.S. Cl. ..... 72/459; 72/31.04; 72/37

[58] Field of Search ..... 72/457, 458, 459, 72/31.04, 37

[56] References Cited

U.S. PATENT DOCUMENTS

| | | | |
|---|---|---|---|
| 4,009,602 | 3/1977 | Linquist | 72/459 |
| 4,442,695 | 4/1984 | Gardner | 72/459 |
| 4,452,064 | 6/1984 | Custin | 72/459 |
| 4,622,837 | 11/1986 | Bergman | 72/459 |
| 5,669,258 | 9/1997 | Luebke | 72/31.04 |

*Primary Examiner*—David Jones
*Attorney, Agent, or Firm*—Quarles & Brady

[57] ABSTRACT

A manually operated conduit bender head for bending electrical conduit, tubing, and the like has a sighting point defined on a lateral side of the handle socket which projects from the handle socket in a plane perpendicular to the handle and bead projections spaced along the length of the side of the shoe to provide reliable sighting of the bend angle imparted by the tool to the conduit or tubing.

4 Claims, 4 Drawing Sheets

CONDUIT BENDER HEAD

CROSS REFERENCES TO RELATED APPLICATIONS

Not applicable.

STATEMENT REGARDING FEDERALLY SPONSORED RESEARCH

Not applicable.

BACKGROUND OF THE INVENTION

This invention relates to hand bender tools for electrical conduit and similar pipes and tubes, and more particularly to a bending tool with sighting and angle indicators for determining the angle of bend of the piece being bent.

Conduit benders, or tube benders as they are known, are commonly used by electricians and others, mainly for bending conduit to run wires and cable through. Such a conduit bender is described, for example, in U.S. Pat. Nos. 4,009,602, Linquist; 4,442,695, Gardner; and 4,622,837, Bergman.

A typical tube bender comprises two parts: a handle and a head. The handle is screwed into the head and the head has an arcuate shoe at the bottom with a laterally concave groove in the bottom of the shoe into which the conduit fits with a small clearance. The head has a hook which is hooked around the conduit received in the groove and the conduit is bent by exerting a force on the handle to roll the shoe along the conduit, with the conduit between the floor and the shoe.

The arcuate bend imparted to the conduit or tubing as the tool head is rocked has a radius substantially equal to that of the arc to which the shoe is curved along its length. The bend angle produced in the conduit is dependent upon the distance through which the handle is swung rearward during the bending operation. The bend angle is the angle between the straight sections of conduit that are at opposite ends of the curve imparted to the conduit by means of the tool.

Without some means to accurately determine the bend angle, the user must estimate the necessary bend, see if the bend was correct by disengaging the tool, and then correct any error by increasing or decreasing the bend in the already bent piece. This procedure is time consuming and expensive in a work environment.

Various means and methods have been developed to provide an accurate determination of the bend angle while bending the conduit. Several methods such as disclosed in U.S. Pat. No. 5,669,258, Luebke, involve attaching a tube bend angle indicator to the tool handle. As the handle is moved to make the bend in the conduit, a pointer or other indicator (e.g., a bubble in a bubble level indicator) moves relative to horizontal to indicate the bend angle. This type of bend angle indicator provides a high degree of accuracy. However, such indicators are not integral parts of the bender and are not always available at a job site.

In U.S. Pat. Nos. 4,442,695, Gardner and 4,009,603, Linquist, markings on the tool head provide a sight line for determining the bend angle by the user. When markings on the tool head were properly aligned during the bend operation, the conduit was substantially bent to the desired bend angle. This type of bend angle indicator can be cast into the head and is less susceptible to damage in a harsh environment.

The invention disclosed in U.S. Pat. No. 4,442,695, Gardner, represented a significant improvement over the arrangement in U.S. Pat. No. 4,009,602, Linquist, in that a more accurate bend angle was obtainable on the job site. Both of these prior art inventions, however, were limited in the number of predetermined bend angles that could be displayed on the bender head. In the Linquist invention, available space for marking angles is limited to a small arc on the front end of the shoe. The Gardner invention solved this problem by providing angle indicators along the length of the shoe, but the upper rib segment of the indicator is crowded on the handle socket, converging on a single apex, thereby limiting the addition of additional angle indicator ribs. The limited number of predetermined bend angles requires the user to estimate bend angles that are not indicated on the tool. Therefore, it is desirable to provide a bending tool with the capability of indicating more predetermined bend angles, thus reducing the amount of estimating required.

BRIEF SUMMARY OF THE INVENTION

The invention provides a bender head for conduit, tubing and the like with an improved sight line bend angle indicator. An outer surface of the handle socket of the head is shaped so as to project from a lateral side of the socket to define a sighting point at the lateral side in a plane which is perpendicular to the handle axis, so that it is visible from the same side of the handle. A plurality of bead projections are spaced along the length of the shoe portion on the same side of the head as the sighting point. Each of the bead projections can be visually aligned with the sighting point along a vertical line of sight by a user operating the handle of the bender.

A general object of the invention is to provide an accurate versatile bending tool that requires less estimating by the user. This is accomplished by providing a sight line point on the handle socket that can be aligned by sight with any one of a number of projections, each representing a different bend angle, spaced along the shoe.

Another object of the invention is to provide a bending tool that is easily used by a user that is either right or left handed. This is accomplished by providing a sight line point and projections on both sides of the bender tool.

These and other advantages and objects of the invention will become evident from the following detailed description and the drawings.

DETAILED DESCRIPTION OF THE PREFERRED EMBODIMENT

Figure 1:
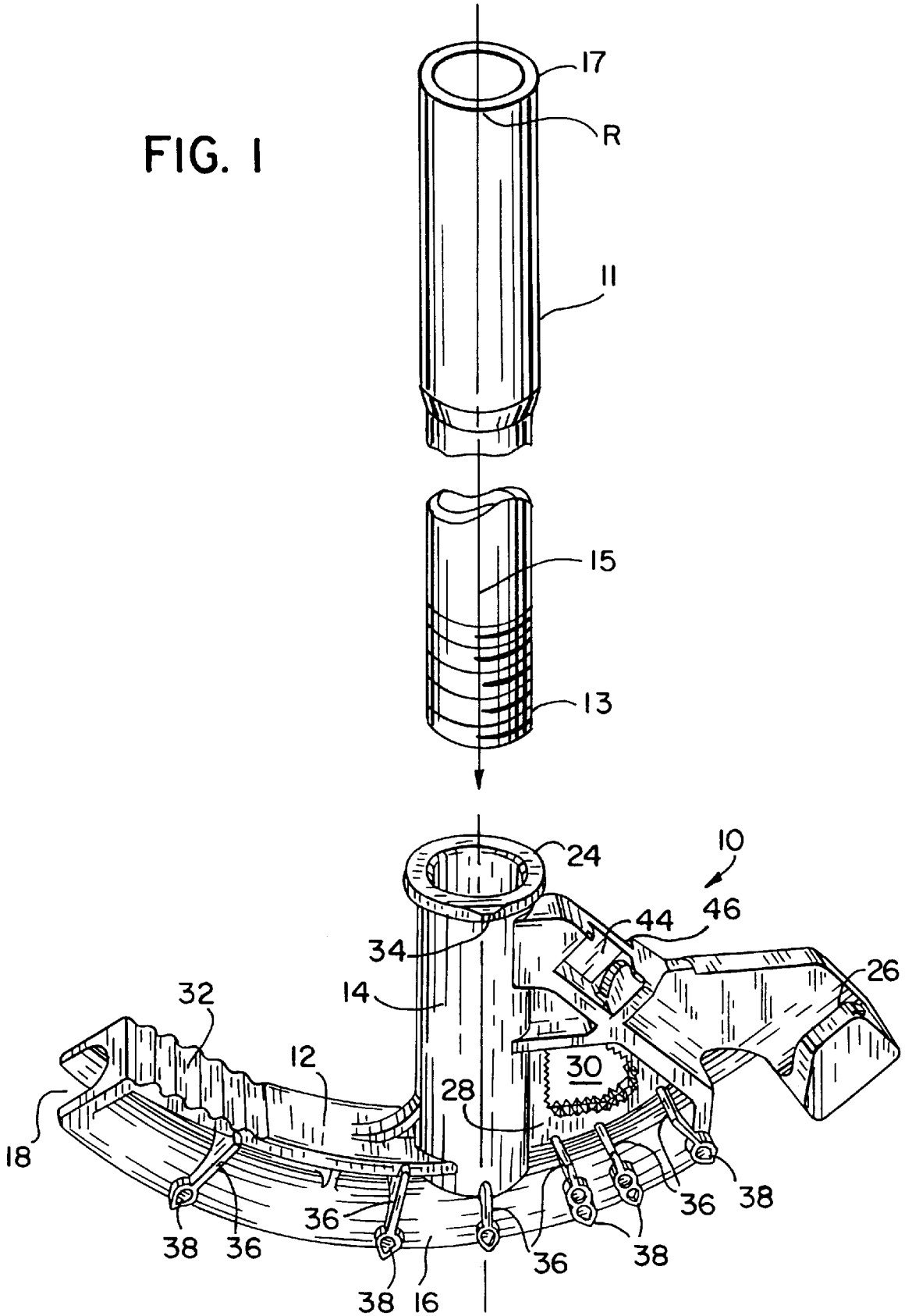
FIG. 1 is a perspective view of a first embodiment of a conduit bender head that employs the present invention.
Figure 2:
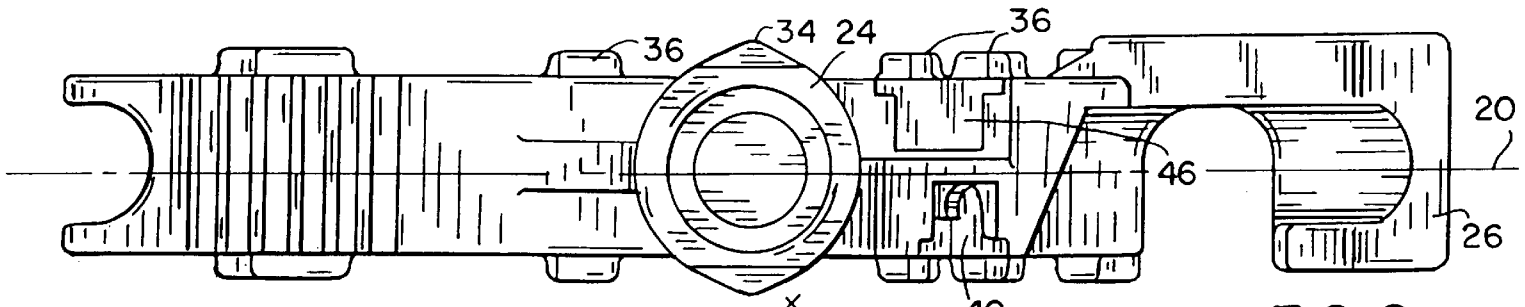
FIG. 2 is a top plan view of the head of FIG. 1.

The invention consists essentially of an improvement to the tube bender as disclosed in U.S. Pat. No. 4,622,837, Bergman, which is commonly owned by the assignee of this application and to the tube bender disclosed in U.S. Pat. No.

4,442,695 to W. E. Gardner. U.S. Pat. Nos. 4,442,695 and 4,622,837 are hereby incorporated by reference herein.

As shown in FIGS. 1–8, a tool head 10 is formed of a one-piece casting 12. Together with an elongated shaft-like handle 11, such as described in U.S. patent application Ser. No. 08/721,156 filed by applicant on Sep. 26, 1996, the head 10 provides a tube bending tool. The handle can be made of rigid steel tubing or the like and is threaded at its lower end 13 so that it can be screwed into upwardly projecting tubular handle socket 14, which is internally threaded and defines the handle axis 15, of the head 10. The head 10 extends both forwardly and rearwardly from the handle socket 14.

Figure 4:
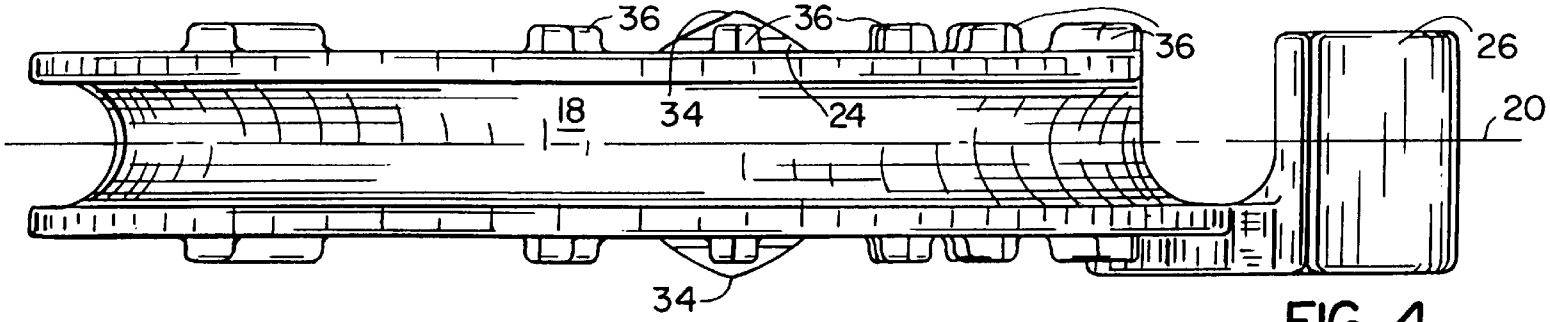
FIG. 4 is a bottom plan view of the head of FIG. 1.

A shoe 16 comprising the bottom portion of the head 10 is curved along its length (longitudinally) in a convex arc. A downwardly opening laterally (side to side) concave groove 18 formed in the bottom of the shoe 16 across its width has a radius substantially equal to that of the tubing to be bent. As shown in FIG. 4, the groove 18 is symmetrical from side to side relative to a plane 20 that lies inside and bisects the head 10 from front to back.

Figure 3:
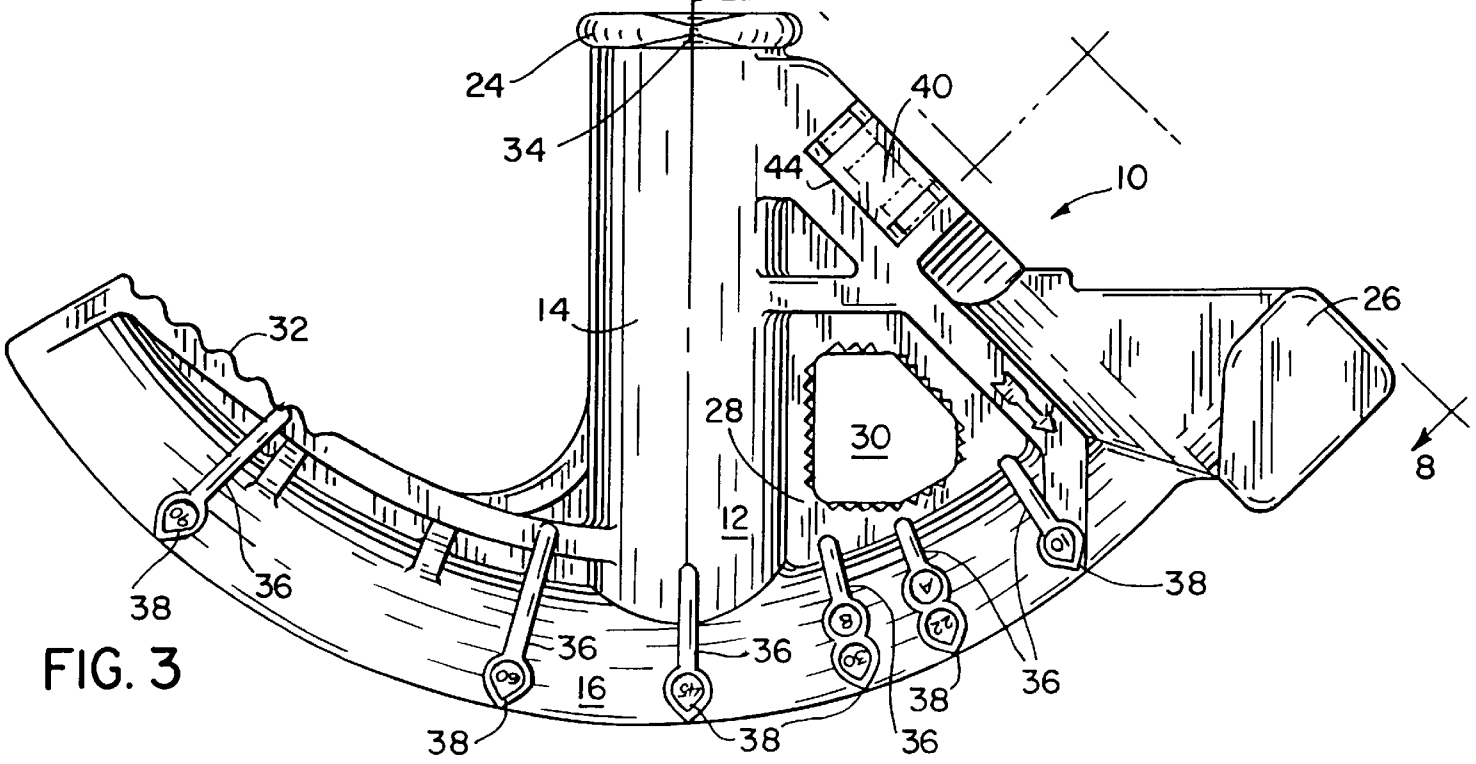
FIG. 3 is a right side elevational view of the head of FIG. 1.
Figure 5:
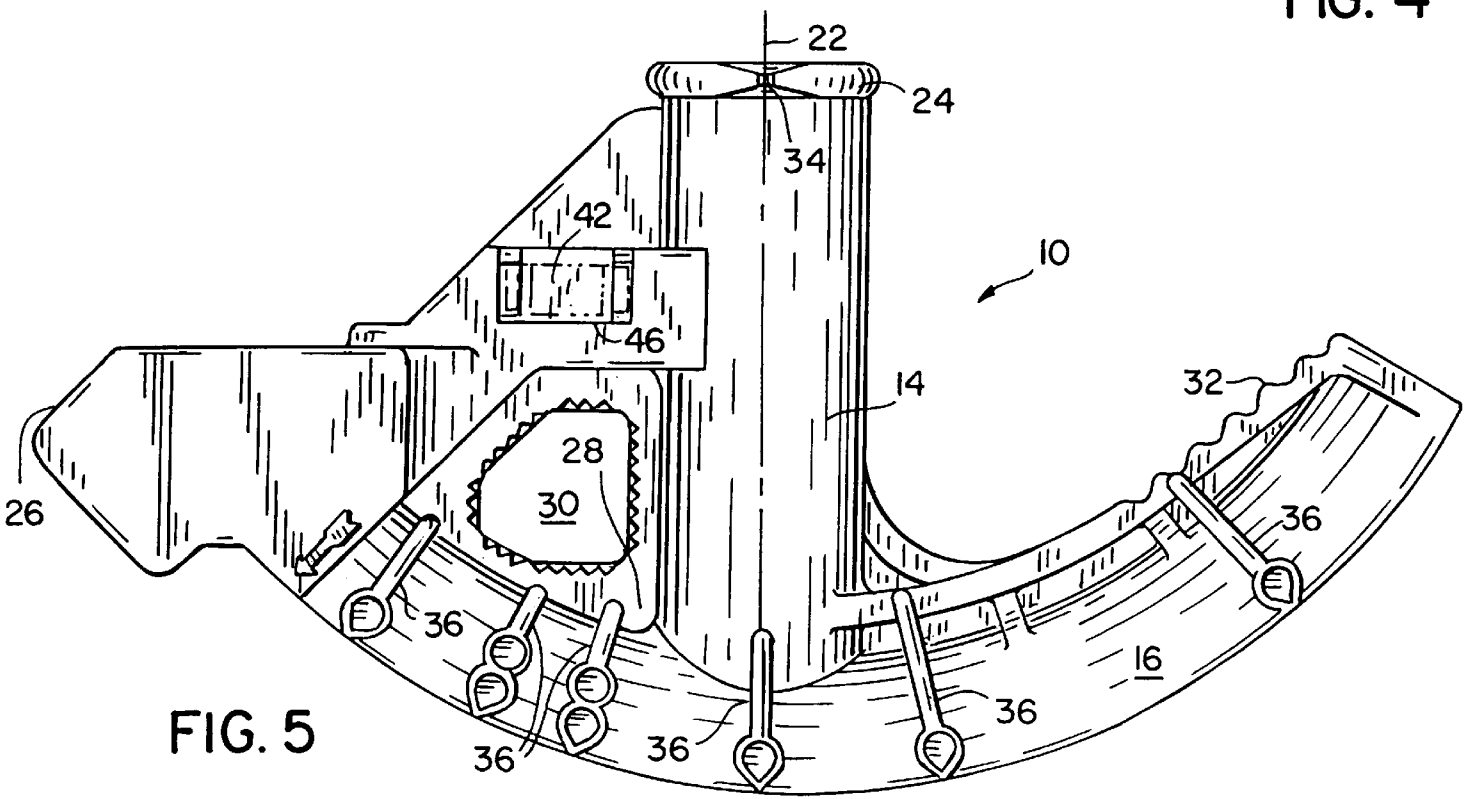
FIG. 5 is a left side elevational view of the head of FIG. 1.

The handle supporting socket portion 14, which is substantially cylindrical, has its axis contained in the plane of symmetry 20. As shown in FIGS. 3 and 5, the socket portion 14 preferably coincides with a radial line 22 through a sighting point 34 which is the center at which the shoe 16 is concentrically curved along its length, i.e., the center of the arc that defines the longitudinal curvature of the shoe 16 is on a lateral line through point 34. A collar 24 is formed on the outer edge at an end of the socket portion 14 furthest away from the shoe 16.

Figure 6:
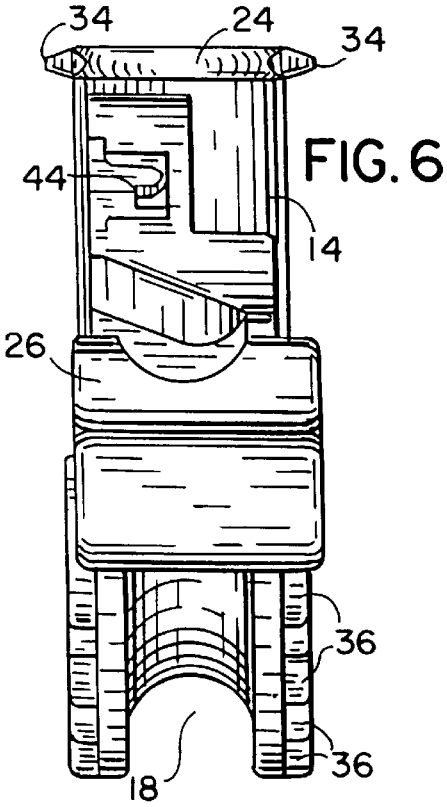
FIG. 6 is a front elevational view of the head of FIG. 1.
Figure 7:
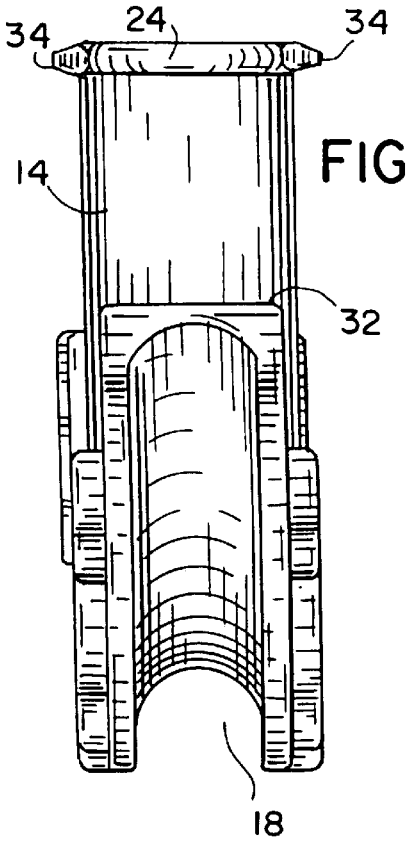
FIG. 7 is a rear elevational view of the head of FIG. 1.
Figure 8:
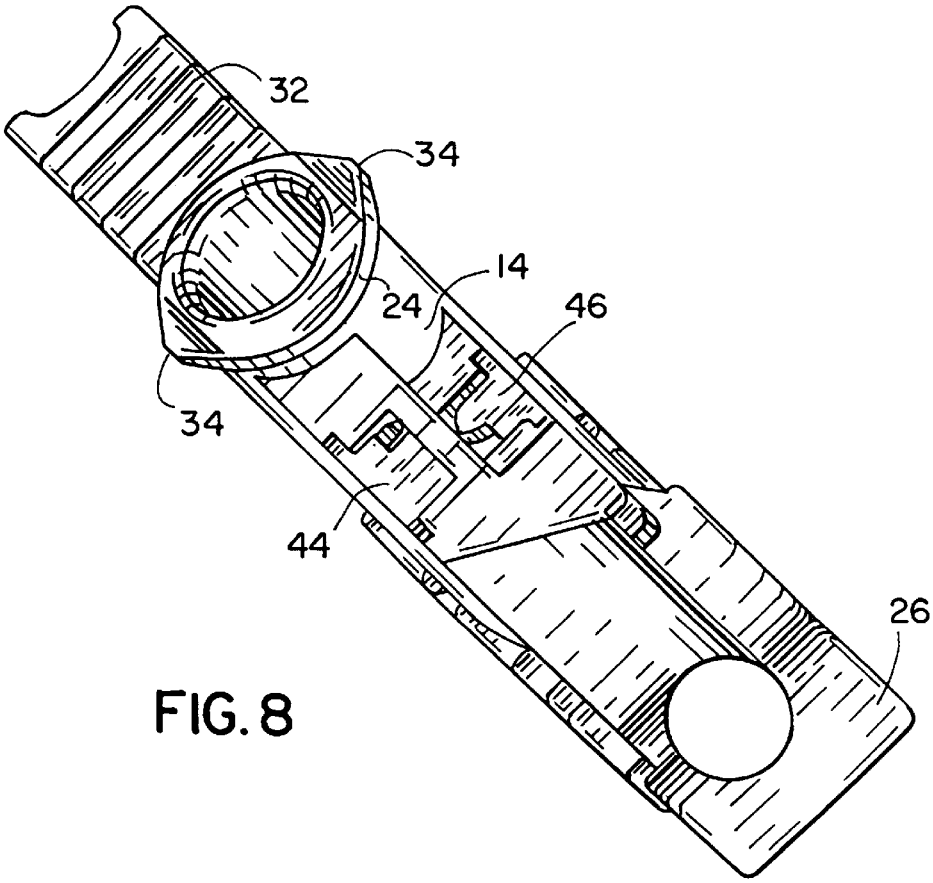
FIG. 8 is a plan view from the plane of the line 8—8 of FIG. 3.

As shown in FIG. 6, the front end portion of the head 10 comprises a forwardly projecting upwardly opening hook 26. The handle socket portion 14 and the hook 26 are connected to the tool head 10 by a front vertical web 28 that is joined to the shoe 16 to support high stresses that are imposed during a bending operation. The web 28 has a serrated opening 30 that provides a positive grip to conduit or tubing inserted therethrough for additional manipulation.

The rear portion of the shoe 16 which projects behind the handle socket portion 14, has its upper surface transversely ridged to define a pedal 32. The user of the tool places a foot on the pedal 32 to hold the shoe 16 down against the tubing being bent and to produce a bending force which supplements the force applied to the handle.

The improvement over the prior art is in the bend angle indicating means. The improvement is that the handle socket of the head is shaped so as to taper to the sighting point 34 on at least one of its lateral sides, to identify the point of curvature of the longitudinal arc of the shoe 16, so that together with the lower bead projections 36 formed on the same lateral side of the shoe 16, an operator operating the handle can visually line up the point 34 with the desired projection 36 along a vertical line, to obtain a sufficiently accurate bend angle. The point 34 is so visible because it projects from the lateral side of the socket 14 in a plane (i.e., the plane of the collar 24) which is perpendicular to the handle axis 15. The point 34 projects in this plane a distance sufficient so that it is visible from any point along the same lateral side of the handle 11, for example from the point R (FIG. 1) on that lateral side at the upper end 17 of the handle 11 and all points directly below the point R on the surface of the handle 11. When the projection 34 on the collar 24 is visually lined up with one of the lower projections 36 while bending a piece of conduit or tubing, the resulting sight line, which is in a plane that is substantially parallel to the plane of symmetry 20 (FIGS. 2 and 4), corresponds to a predetermined bend angle. Preferably, identical sighting points and corresponding bead projections are formed on both lateral sides of the bender, providing equally convenient use for an operator that is left or right handed.

Bead markings 38 on the shoe 16 indicate the bend angle that corresponds to a particular ridge segment 36 on the shoe 16. Looking particularly at FIG. 3, bend angle markings 38 are cast into tear drop shaped projections on the shoe 16 that are in line with a corresponding ridge segment 36. Additional markings 37, such as letter indicators, are also cast in line with a ridge segment 36 to provide additional information to the user.

By providing a sighting point 34 on the collar 24 of the bender 10 which is visible by a user operating the handle 11, the tool 10 is not limited to a small number of predetermined bend angles by the limited space on the handle socket portion 14. Furthermore, the entire shoe length provides ample space for narrow ridge segments 36, indicating bend angles within the range of angles that can be produced by the bender 10. As a result, a greater number of predetermined bend angles can be indicated in the present invention than was previously available in the prior art.

Additionally, level vials, 40 and 42, at predetermined bend angles of 45° and 90°, provides a second reliable means for determining whether the tool 10 is providing one of these particular bends in the conduit, tube, or the like. Vial 40 securely mounted in a cavity 44 formed in head 10 of the bender is filled with a liquid so as to form a bubble and has marked thereon horizontal indication lines. When the bubble is centered, the bender forms a bend angle of 90°. Similarly, vial 42 securely mounted in a cavity 46 indicates a bend angle of 45° when a bubble in the vial 42 is centered between horizontal indicators on the vial 42. The vials, 40 and 42, are conventionally mounted as disclosed in U.S. Pat. No. 4,622,837, Bergman, which has been incorporated herein by reference.

Bending a length of conduit with the tool 10 of this invention is generally conventional in that the hook 26 is engaged under the conduit and then, with the conduit otherwise supported by the floor, and with the shoe 16 straddling the conduit, force is applied to the pedal 32 and the handle in the direction to swing the handle rearward. This rocks the head 10 on the arc of the shoe 16, raising the hook 26, which cooperates with the floor to bend the conduit around the shoe 16.

The arcuate bend imparted to the conduit or tubing as the tool head 10 is rocked has a radius substantially equal to that of the arc to which the shoe 16 is curved along its length. The bend angle produced in the conduit is determined by the user lining up the projection point 34 on the socket collar 24 with one of the ridge segments 36 on the shoe 16, so that the user's eye, the point 34 and the desired ridge segment 36 all lie in a vertical line. The angle indicated on the marking 38 corresponding to the ridge segment 36 on the shoe 16 directly below the projection point 34 on the collar 24 is the bend angle. Angles in between ridge segments 36 on the shoe 16 can be estimated or additional ridge segments 36 can be attached to the shoe 16. However, with the improved ability to provide numerous ridge segments 36 on the shoe 16, less estimating or modifications by the user is necessary.

While there has been shown and described what are at present considered the preferred embodiment of the invention, it will be obvious to those skilled in the art that various changes and modifications can be made therein without departing from the scope of the invention. For example, rather than provide the sighting point 34 as a flattened projection, it could be formed as a V-shaped notch in the collar 24, so that the bead projections 38 would be visually lined up in the V-shaped notch. A projection, however, is preferred to a notch, since a notch is only symmetrically lined up with the bead that is directly beneath it when the handle is vertical, and is not able to be perfectly symmetrically lined up with the other beads when the handle is not vertical. Thus, the invention should not be limited to the embodiment described, but should be defined by the claims which follow.

I claim:

1. In a conduit bender head of the type having an upwardly projecting tubular handle socket defining a handle axis and having an upper open end for inserting and affixing a handle to said head, with said handle extending upwardly along said axis, an elongated bottom shoe portion integrally connected to said socket and defining a downwardly opening groove which is convexly arcuate along its length and is concavely arcuate laterally and a conduit engaging hook at an end of said shoe for hooking around a conduit which is received in said groove, the improvement wherein an outer surface of said socket is shaped so as to project from a lateral side of said socket in a plane which is perpendicular to said handle axis to define a sighting point at said lateral side which is visible by a user's eye from the same lateral side of said handle, and a plurality of bead projections are spaced along the length of said shoe portion on the same lateral side of said head as said sighting point so that each of said bead projections can be visually aligned with said sighting point along a line of sight by a user operating said handle, wherein said socket is formed to define a collar around its upper end, and said collar projects to define said sighting point at said lateral side of said socket.

2. The improvement of claim 1, wherein said sighting point and said projections lie in a longitudinal plane which is substantially parallel with a longitudinal plane of symmetry of said groove.

3. The improvement of claim 1, wherein a sighting point and corresponding bead projections are formed on both lateral sides of said head.

4. In a conduit bender head of the type having an upwardly projecting tubular handle socket defining a handle axis and having an upper open end for inserting and affixing a handle to said head, with said handle extending upwardly along said axis, an elongated bottom shoe portion integrally connected to said socket and defining a downwardly opening groove which is convexly arcuate along its length and is concavely arcuate laterally and a conduit engaging hook at an end of said shoe for hooking around a conduit which is received in said groove, the improvement wherein an outer surface of said socket is shaped so as to project from a lateral side of said socket in a plane which is perpendicular to said handle axis to define a sighting point at said lateral side which is visible by a user's eye from the same lateral side of said handle, and a plurality of bead projections are spaced along the length of said shoe portion on the same lateral side of said head as said sighting point so that each of said bead projections can be visually aligned with said sighting point along a line of sight by a user operating said handle, wherein said sighting point is defined by a projection of said socket which tapers to a point.

* * * * *